United States Patent [19]

Weir

[11] Patent Number: 4,562,608

[45] Date of Patent: Jan. 7, 1986

[54] CHIMNEY CLEANING BRUSH

[76] Inventor: Harvey J. Weir, Henribourg, Saskatchewan, Canada S0J 1C0

[21] Appl. No.: 625,874

[22] Filed: Jun. 29, 1984

[30] Foreign Application Priority Data

Jun. 29, 1983 [CA] Canada ..... 431395

[51] Int. Cl.[4] ..... A46B 7/02

[52] U.S. Cl. ..... 15/163; 15/165; 15/104.2

[58] Field of Search ..... 15/162, 163, 165, 249, 15/242, 243, 104.2

[56] References Cited

U.S. PATENT DOCUMENTS 1,875,613 9/1932 Kahlert et al. ..... 15/163

2,219,555 10/1940 Burwell ..... 15/162

FOREIGN PATENT DOCUMENTS 87954 7/1896 Fed. Rep. of Germany ..... 15/163

236202 5/1945 Switzerland ..... 15/243

*Primary Examiner*—Peter Feldman

*Attorney, Agent, or Firm*—Beveridge, DeGrandi & Weilacher

[57] ABSTRACT

This invention relates to a brush for cleaning chimneys, which brush can be passed in a folded configuration through a chimney in one direction. The brush can then be passed in the opposite direction through the chimney, and assumes during such passage an unfolded configuration, such opposite direction passage acting to maintain it in such unfolded configuration.

8 Claims, 6 Drawing Figures

CHIMNEY CLEANING BRUSH

This invention relates to a brush apparatus for cleaning chimneys, and more particularly, to that type of brush apparatus that can be passed in one direction through a chimney in a folded configuration and subsequently passed through the chimney in the other direction in an unfolded cleaning configuration.

Of known types of such chimney cleaning brush apparatii, there are at least two means by which the brushes of such apparatii are biased against the chimney walls. One type of apparatus utilizes a portion of its own weight as the biasing force. A second type of apparatus utilizes spring bias to force the brushes against the chimney walls. The first type of apparatus is illustrated in U.S. Pat. Nos. 77,466 and 1,104,030, and Canadian Pat. No. 340,884. In U.S. Pat. No. 77,466 a pivotal frame assembly is disclosed which unfolds under its own weight and can be locked in the folded and unfolded configurations. In U.S. Pat. No. 1,104,030 a vertically-slidable runner is pivotally connected to a series of radial spokes each of which act to pivot outwardly a respective one of a series of circumferentially-spaced brushes; the weight of the runner is sufficient to force the brushes outwardly. A similar arrangement is employed in Canadian Pat. No. 340,884 in which a double pair of brush arms are each biased outwardly by a central dependent weight. The second type of apparatus is illustrated in U.S. Pat. Nos. 1,096,559; 1,603,153; 1,926,753 and 2,284,391, and in Canadian Pat. Nos. 215,597; 399,398 and 655,195.

Other means of outwardly biasing chimney cleaning brushes are disclosed in other references. For instance, U.S. Pat. No. 361,502 discloses a chimney cleaning device in which a series of arms each having a respective brush at their one end are pivoted at their other end to a common collar. The cable for raising the device through the chimney is connected to a cross brace having the brush arms slidably connected to its periphery such that a tension force applied to the cable acts to both lift the device in the chimney and move the brushes outwardly. A still further form of chimney cleaning brush apparatus is disclosed in U.S. Pat. No. 1,801,718 in which each pair of brushes extend from an opposite end of a leaf spring the curvature of which is determined by a centrally disposed threaded tightening rod. The position of the brushes are adjusted prior to movement of the device through the chimney. Canadian Pat. No. 508,709 discloses a chimney cleaning apparatus having a rotatable handle which, when rotated, acts to extend a pair of pivotally-mounted brushes outwardly against the chimney walls. The handle is connected to an in-line screw gear which meshes with a complementary gear secured to pivoting arms on which the brushes are fixed. In operation, the device can be moved in a folded configuration through the chimney, then unfolded by rotation of the handle, then moved in the other direction through the chimney with the brushes in the unfolded configuration and in contact with the chimney walls.

The subject invention is a chimney cleaning brush apparatus which is simpler in construction than those disclosed in the prior art, albeit as effective in operation. The apparatus of the subject invention is adapted to be passed in one direction through a chimney in a folded configuration and to be passed in the other direction through the chimney in an unfolded configuration. The apparatus comprises a frame member and pair of brush members each pivotally secured to the frame member such that their pivot axes extend in generally parallel relation. Each of the brush members in the unfolded configuration extend such that their respective cleaning edges contact a respective one of an opposite pair of the walls of the chimney. The brush members are pivotable in only one direction from such unfolded configuration, and the contact between the cleaning edges of the brush members and the walls of the chimney act to maintain the brush apparatus in the unfolded configuration as it is passed through the chimney in the other direction.

In a further form of the subject invention, the chimney cleaning brush apparatus further comprises a second pair of brush members each pivotally secured to the frame member at a position displaced on the frame member from the first pair of brush members. The pivot axes of the second pair of brush members also extend in generally parallel relation to each other. Each of the second pair of brush members in the unfolded configuration extend such that their respective cleaning edges contact a respective one of a second opposite pair of the walls of the chimney. The two pairs of brush members are pivotable in only one direction from the unfolded configuration, the contact between the cleaning edges of the two pairs of brush members and the walls of the chimney acting to maintain the brush apparatus in the unfolded configuration as it is passed through the chimney in the other direction.

In the further form of the subject invention, the pivot axes of the second pair of brush members may extend generally perpendicular to the pivot axes of the first pair of brush members. Also, in the second form of the subject invention the cleaning edges of the brush members in the unfolded configuration may contact substantially the entire inner periphery of the chimney. The brush members in either the first or further form of the subject invention may be configured for passage through a chimney of either a generally circular inner cross-section or generally rectangular inner cross-section. Also, in either the first or further forms of the invention the apparatus may be passed in one direction through the chimney by lowering it on a cable attached thereto and passed in the other direction through the chimney by applying tension to the cable to raise the apparatus.

In the further form of the subject invention, the frame member may comprise a rigid rod extending along the symmetry axis of the chimney. The rigid rod has a first end and a second end, one pair of the brush members being pivotally secured to the first end and the second pair of brush members being pivotally secured to the second end.

The invention will now be more fully described by means of a preferred embodiment utilizing the accompanying drawings in which.

Figure 1:
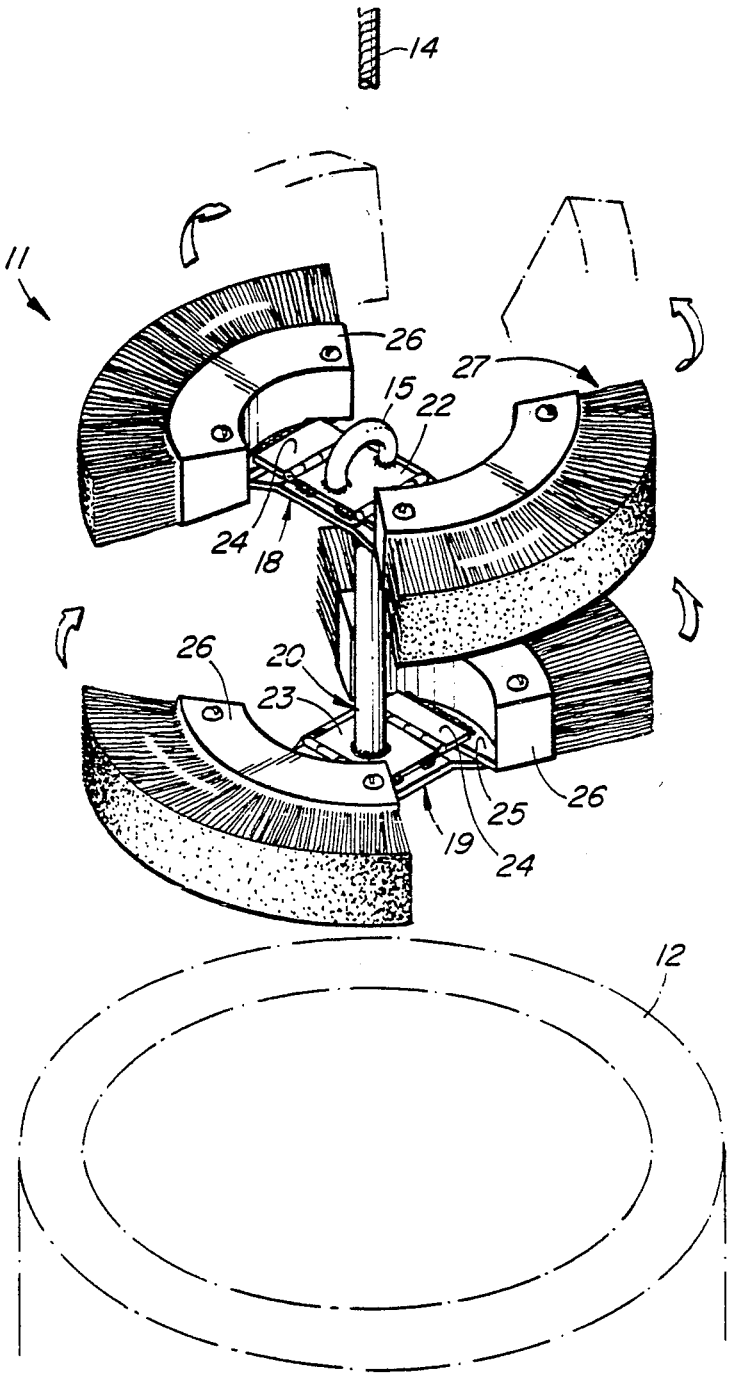
FIG. 1 is a perspective view of that form of the brush apparatus having both first and second pairs of brush members.

With reference to FIG. 1, the brush apparatus of the preferred embodiment is generally designated as 11, and the chimney which it is adapted to clean is designated as 12. The brush apparatus is suspended from a cable 14, the cable 14 being connected to eyelet 15 of brush apparatus 11 by a corresponding eyelet (see FIG. 5) formed in the end of cable 14. Brush apparatus 11 has a pair of generally parallel support brackets 18 and 19 each extending generally normally offset from the other. Support brackets 18 and 19 each are rigidly connected to an opposite end of a cylindrical spacer bar 20 so as to be maintained in generally parallel spaced relation.

Figure 2:
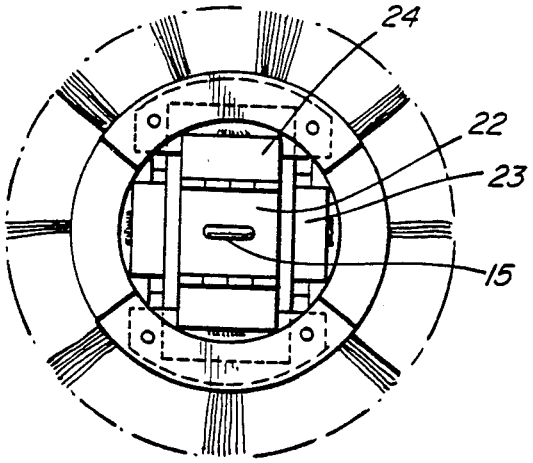
FIG. 2 is a plan view of the brush apparatus of FIG. 1.
Figure 3:
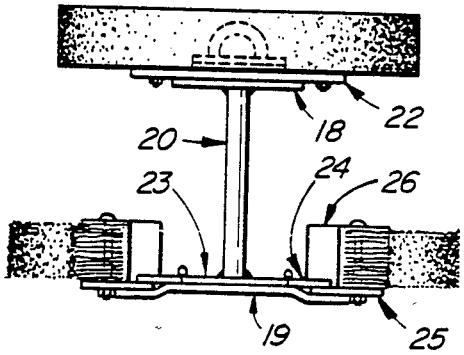
FIG. 3 is a side view of the brush apparatus of FIG. 1.
Figure 4:
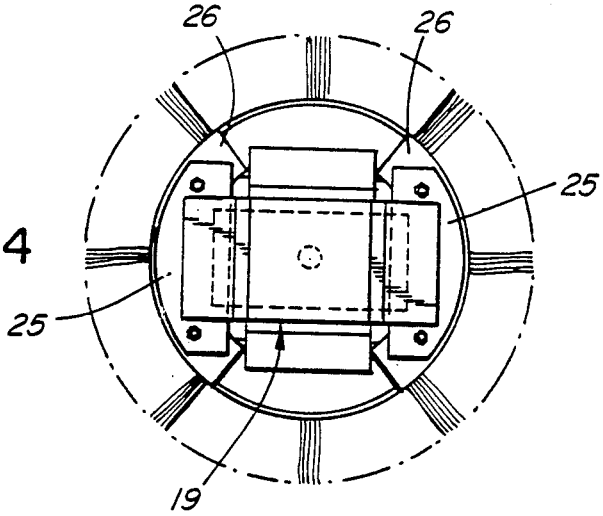
FIG. 4 is a bottom view of the brush apparatus of FIG. 1.

As shown in FIGS. 3 and 4, support bracket 19 is of generally rectangular shape and has the outer portions of its longer dimension formed in parallel offset relation to the central portion. The reason for this configuration of support bracket 19, which is also possessed by support bracket 18, will subsequently become clear. Resting on and secured to support brackets 18 and 19 are a respectively associated pair of double hinge members 22 and 23. As shown in FIGS. 1, 2 and 3, each double hinge member 22 and 23 has a central portion connected to the respective support bracket 18 and 19 and also has a pair of hinged end portions 24. Welded to each of the end portions 24 is a plate 25 which in turn is connected by fasteners to the arcuate head 26 of a respective arcuately-shaped brush 27.

Figure 5:
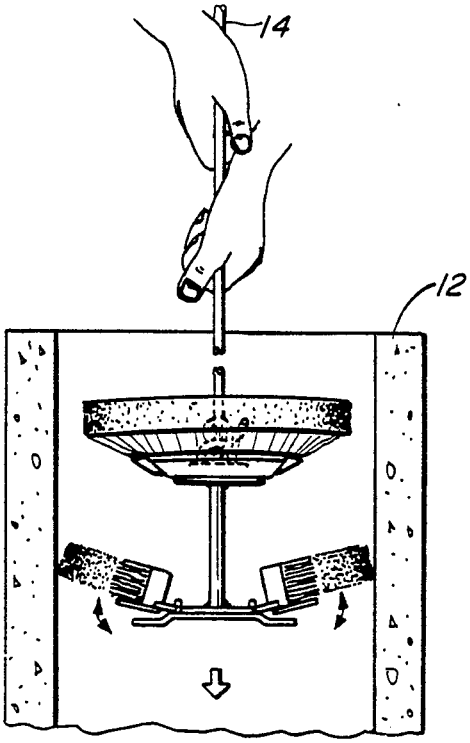
FIG. 5 is a side view of the brush apparatus of FIG. 1 illustrating displacement of the brush members during movement of the brush apparatus in the one direction through the chimney.
Figure 6:
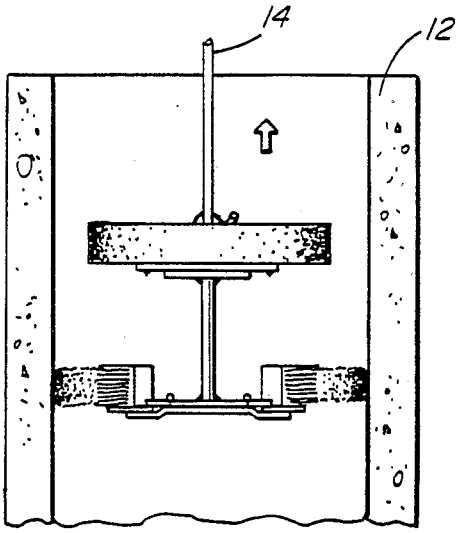
FIG. 6 is similar to FIG. 5, but illustrates the position of the brush members during movement of the brush apparatus in the other direction through the chimney.

FIGS. 5 and 6 illustrate the brush apparatus of the preferred embodiment being respectively lowered and raised in the circular chimney 12 which has a diameter slightly less than the diameter assumed by the outer periphery of the four brush members of the brush apparatus in the unfolded configuration. As can be seen in FIG. 5, during motion of the brush apparatus in a downward direction through the chimney 12, the outer end of each brush 27 rubs against the periphery of the chimney inner surface and the hinged end portions 24 of the double hinge members 22 and 23 are pivoted at an upward angle relative to the central portion of those members. Once the brush apparatus of the preferred embodiment has been lowered to the base of the chimney, a tension force is applied on cable 14 to raise the apparatus through the chimney. The upward movement pivots each of the brushes 27 to a horizontal position. The purpose of having the outer portions of support brackets 18 and 19 in parallel offset relation relative to their central portions should now be evident. The outer portions of support brackets 18 and 19 allow brush members 27 to pivot to a horizontal position by providing a seat for each of the plates 25. The amount of offset between the planes of the central and outer portions of the support brackets 18 and 19 is the thickness of the plate 25.

The brush apparatus utilized for cleaning a particular chimney is sized according to the inner periphery of the chimney. In the case of a chimney having a circular inner periphery, the diameter of the brush apparatus when unfolded is made slightly greater than the inner diameter of the chimney. If the chimney has a rectangular inner periphery, the distance between the opposite pairs of striaght edges of the brushes 27 in the unfolded apparatus is made slightly greater than the corresponding dimension in the chimney.

I claim:

1. A chimney cleaning brush apparatus adapted to be passed in one direction through a chimney in a folded configuration and to be passed in the other direction through the chimney in an unfolded configuration, the brush apparatus comprising a frame member and multiple pairs of brush members, each pair of brush members being pivotally secured to the frame member such that the pivot axis of each brush member of the pair of brush members extends in generally parallel relation to the pivot axis of the other brush member of the pair of brush members, each pair of brush members being displaced on the frame member relative to each other pair of brush members in the direction on the frame member corresponding to that in which the frame member is adapted to extend in the chimney, that relative displacement being such that each pair of brush members does not act to limit the position assumed by any other pair of brush members when the apparatus is passed through the chimney in the folded configuration, each pair of brush members in the unfolded configuration extending such that their respective cleaning edges contact a respective opposing pair of surfaces of the chimney, each brush member being pivotable around its pivot axis in only one direction from the unfolded configuration, the contact between the cleaning edges of the brush members and the surfaces of the chimney acting to maintain the brush apparatus in the unfolded configuration as it is passed through the chimney in the other direction, the orientation of the pivot axes of each pair of brush members being offset from the pivot axes of each other pair of brush members of the apparatus so as to stabilize the passage of the apparatus through the chimney in the unfolded configuration.

2. A chimney cleaning brush apparatus as in claim 1, wherein the apparatus comprises two pairs of brush members.

3. A chimney cleaning brush apparatus as in claim 2, wherein the pivot axes of the second pair of brush members extend generally perpendicular to the pivot axes of the first pair of brush members.

4. A chimney cleaning brush apparatus as in claim 3, wherein the cleaning edges of the brush members in the unfolded configuration of the apparatus contact substantially the entire inner periphery of the chimney.

5. A chimney cleaning brush apparatus as in claim 1, 2 or 3, wherein the brush members are configured for passage through a chimney of generally circular inner cross-section.

6. A chimney cleaning brush apparatus as in claim 1, 2 or 3, wherein the brush member are configured for passage through a chimney of generally rectangular inner cross-section.

7. A chimney cleaning apparatus as in claim 1, 2 or 3, wherein the apparatus is passed in one direction through the chimney by lowering it on a cable attached thereto, and the apparatus is passed in the other direction through the chimney by applying tension to the cable to raise the apparatus.

8. A chimney cleaning brush apparatus as in claim 3, wherein the frame member comprises a rigid rod extending along the symmetry axis of the chimney, the rigid rod having a first end and a second end, one pair of the brush members being pivotally secured to the first end of the rigid rod and the second pair of brush members being pivotally secured to the second end of the rigid rod.

* * * * *